US005239853A

United States Patent [19]

Kutschker

[11] Patent Number: 5,239,853

[45] Date of Patent: Aug. 31, 1993

[54] DEVICE FOR BENDING SHEET METAL

[75] Inventor: Wolfgang Kutschker, Böblingen, Fed. Rep. of Germany

[73] Assignee: Reinhardt Maschinenbau GmbH, Sindelfingen, Fed. Rep. of Germany

[21] Appl. No.: 847,078

[22] PCT Filed: Aug. 30, 1990

[86] PCT No.: PCT/EP90/01445

§ 371 Date: Apr. 7, 1992

§ 102(e) Date: Apr. 7, 1992

[87] PCT Pub. No.: WO91/06382

PCT Pub. Date: May 16, 1991

[30] Foreign Application Priority Data

Oct. 26, 1989 [DE] Fed. Rep. of Germany ..... 3935659

[51] Int. Cl.[5] ..... B21D 5/04

[52] U.S. Cl. ..... 72/319; 72/7

[58] Field of Search ..... 72/319-322, 72/316, 7

[56] References Cited

U.S. PATENT DOCUMENTS

| | | | |
|---|---|---|---|
| 2,782,832 | 2/1957 | Shaw | 72/321 |
| 4,493,200 | 1/1985 | Rhoades | 72/319 |
| 4,557,132 | 12/1985 | Break | 72/319 |
| 4,768,367 | 9/1988 | Favrin | 72/319 |

FOREIGN PATENT DOCUMENTS

| | | |
|---|---|---|
| 242309 | 10/1987 | European Pat. Off. . |
| 2630896 | 1/1978 | Fed. Rep. of Germany . |
| 2160702 | 7/1973 | France . |

*Primary Examiner*—Daniel C. Crane

*Attorney, Agent, or Firm*—Shenier & O'Connor

[57] ABSTRACT

A folding machine in which a metal sheet is clamped between an upper and lower clamp, and the section of sheet extending out beyond the clamps is bent through a given angle by a bending cheek. During the rotating motion of the bending cheek, the bending cheek moves into an initial position perpendicular to the axis of rotation. This steers the bending cheek along a given bending contour.

3 Claims, 2 Drawing Sheets

DEVICE FOR BENDING SHEET METAL

The invention relates to a device for bending a metal sheet.

During the bending of sheet metal with conventional swivel bending machines, the bending jaw (and possibly also the lower jaw) have to be suitably adjusted in dependence upon the thickness of the respective metal sheet to be bent, which involves considerable apparatus and time expenditure. Furthermore, in the known bending process, the bending jaw slides along the sheet metal section to be bent during the bending operation, which results in undesired sliding friction and strain on the surface of the metal sheet.

In general, known swivel bending machines are adjusted prior to the bending such that the swivel axis of a bending jaw which is swivelled from the bottom upwards lies at a spacing above the upper or bending surface of the bending jaw which corresponds to approximately 1.5 times the thickness of the sheet metal. This spacing must be specified in advance to avoid undesired compression of the sheet metal during the swivel movement of the bending jaw. A further disadvantage of the known bending process is that ugly, irregularly rounded bending contours which, in particular, deviate from the circular shape often occur.

A device is known from U.S. patent application No. 4 557 132. In this known device, the swivel axis of the bending jaw is slidable in a relatively short, arcuate slot so that an edge of the bending jaw essentially always engages the same place on a sheet metal section to be bent. It is not possible to obtain certain, predetermined bending contours with the known machine. Also the bending jaw thereof has to be preset to the respective thickness of the metal sheet.

The object of the invention is to so improve a generic device that while reducing the slide path between bending jaw and bent sheet metal section, optional and uniform bending contours can be produced and the swivel axis of the bending jaw no longer has to be preset in dependence upon the thickness of the sheet metal.

Figure 1:
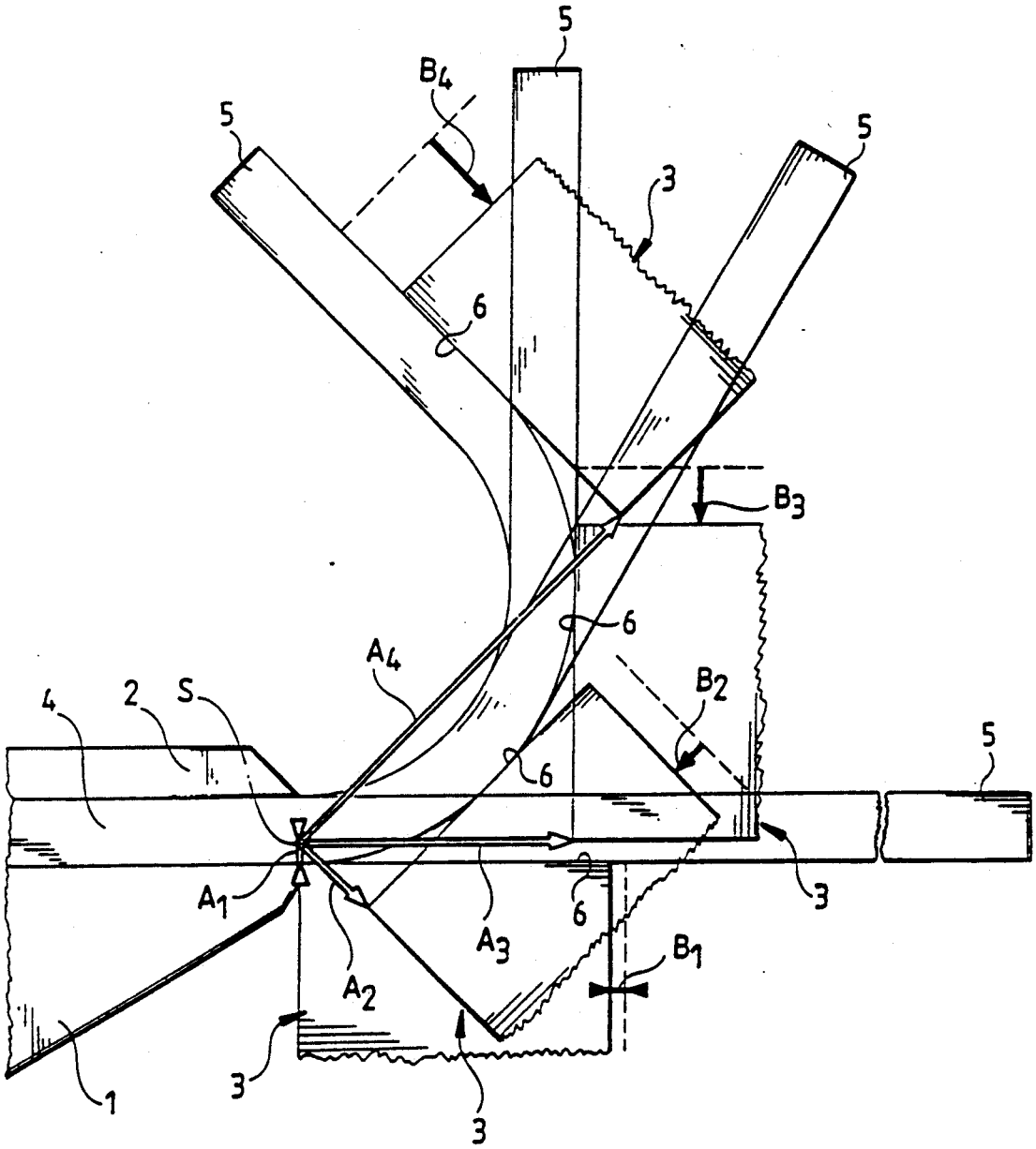

The following description of a preferred embodiment serves in conjunction with the appended drawings to explain the invention in further detail. The drawings show:

FIG. 1 schematically the bending of a metal sheet and

Figure 2:
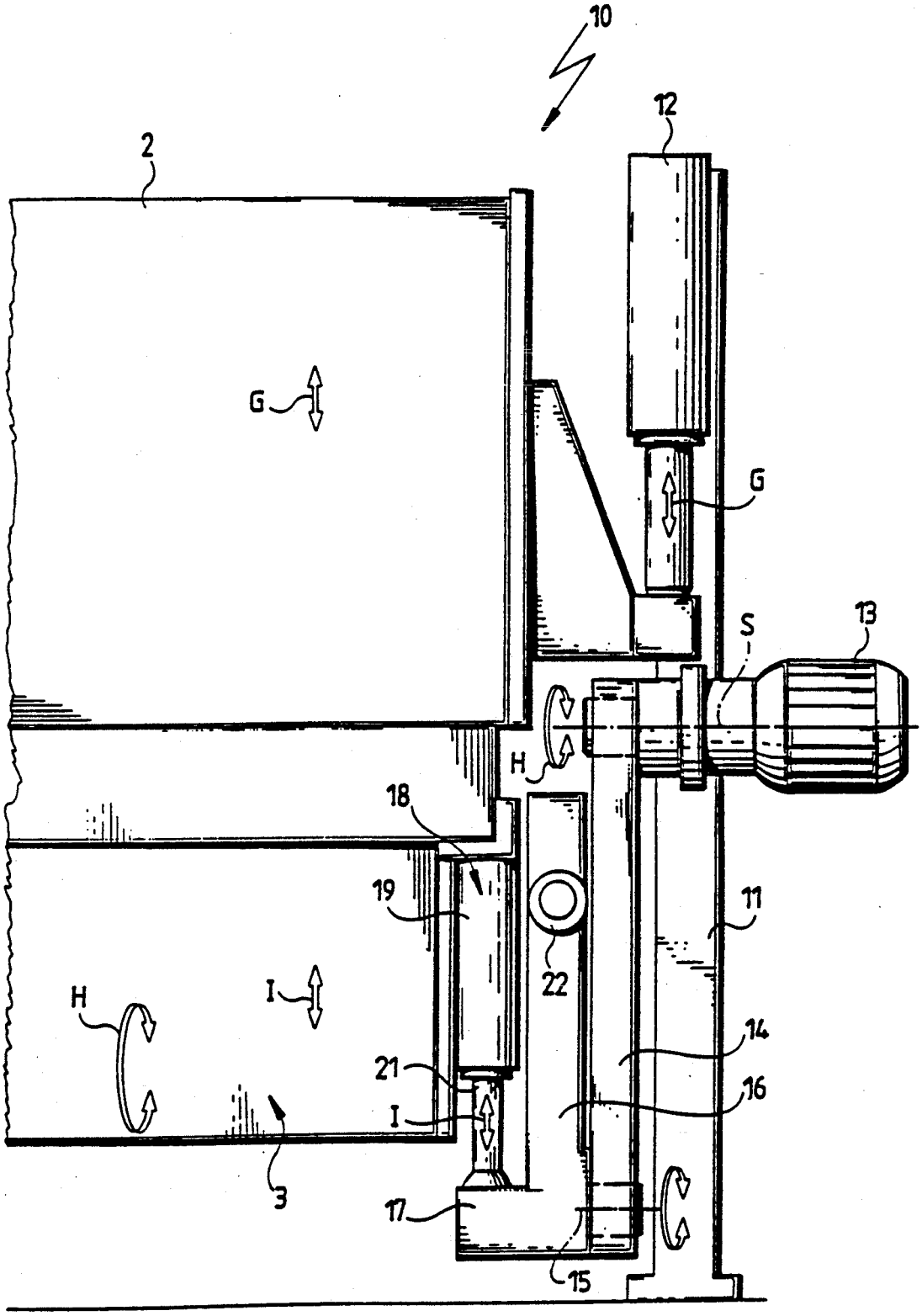

FIG. 2 schematically a swivel bending machine.

FIG. 1 shows schematically the lower jaw 1, the upper jaw 2 and the bending jaw 3 of the bending machine known per se and not illustrated in further detail. A metal sheet 4 is clamped between lower jaw 1 and upper jaw 2 and protrudes with a sheet metal section 5 which is to be bent over the front edges of the jaws 1 and 2. The bending jaw 3 is mounted in the machine frame for swivel movement about an axis S which in FIG. 1 extends perpendicularly to the drawing plane.

In the embodiment of FIG. 1, the swivel axis S extends, as illustrated, within the metal sheet 4. With the conventional swivel bending machine, the metal sheet could not be bent with the swivel axis in such a position because the metal sheet would undergo considerable compression upon execution of the swivel movement of the bending jaw 3. Therefore, heretofore, the swivel axis S was always arranged somewhat outside the metal sheet 4 and above the upper or bending surface 6 of the bending jaw at a spacing which was approximately 1.5 times the thickness of the metal sheet 4.

In order to avoid compression of the sheet metal during the bending and to achieve a uniform, predetermined bending contour of the bent sheet metal section 5, in accordance with the invention the bending jaw 3 is adjusted during its swivel movement in dependence upon the bending angle which is passed through in a first direction of adjustment perpendicular to the swivel axis S and to its bending surface 6. This adjustment is indicated by the respective arrows $A_1$ to $A_4$ in FIG. 1.

Prior to commencement of the bending operation, the bending jaw 3 assumes the position corresponding to arrow $A_1$. In a first phase of the bending operation, the bending jaw 3 is swivelled into the position corresponding to arrow $A_2$ and simultaneously pushed back relative to the swivel axis S and perpendicular to it by an amount which corresponds to the difference in length between arrows $A_1$ and $A_2$. In this phase, the bending surface 6 of the jaw 3 slides along the underside of the metal sheet 4, but the sliding friction path between bending jaw 3 and metal sheet 4 is reduced to a considerable extent in comparison with conventional sheet metal bending owing to the withdrawal of the bending jaw 3 (cf. arrows $A_1$ and $A_2$) so that the surface of the metal sheet undergoes less strain and, consequently, less damage on its underside.

The adjustment of the bending jaw in the direction perpendicular to the swivel axis S during passage through the bending angle between arrows $A_1$ and $A_2$ is controlled in accordance with the invention such that the bending jaw is guided along a predetermined bending contour. A predetermined, in particular, perfectly round shape can thereby be imparted to the metal sheet 4 in the region of this contour and, as mentioned previously, compression of the metal sheet 4 can be excluded.

In the embodiment of the invention according to FIG. 1, the swivel axis S lies merely by way of example within the metal sheet 4. It could also lie at a different place, in particular, also outside the metal sheet 4.

After the position corresponding to arrow $A_2$ has been reached, the bending operation is continued until the bending jaw 3 has reached the position corresponding to arrow $A_3$ in which the sheet metal section 5 is now bent through approximately 90°. From the difference in length between arrows $A_2$ and $A_3$, the adjustment path of the bending jaw 3 relative to its swivel axis S is again evident. Here the bending jaw 3 has again rolled along the underside of the metal sheet 4 with a reduced slide path.

By continuing its swivel movement, the bending jaw 3 finally reaches the position corresponding to arrow $A_4$. The difference in length between arrows $A_3$ and $A_4$ again indicates the adjustment path of the bending jaw perpendicular to its swivel axis S in the course of this last phase of the swivel bending operation.

In any case, the adjustment of the bending jaw 3 in the direction of the arrows A is carried out such that a predetermined bending contour is obtained, no compression of the metal sheet 4 occurs and the sliding friction between bending jaw 3 and metal sheet 4 is considerably reduced.

Attention is again called to the fact that with the conventional sheet metal bending machines, the spacing of the bending jaw 3 from the swivel axis S represented by the arrows A in FIG. 1 remains constant, whereas in accordance with the invention it changes. This change can be brought about for example, in a program-controlled manner or also manually.

In the operation described hereinabove, the slide path between bending jaw 3 and metal sheet 4 is indeed considerably reduced in comparison with conventional processes and the metal sheet is thereby treated with care.

However, as a rule, the slide path cannot be reduced to zero merely by the adjustment of the bending jaw 3 in the direction of the arrows A, i.e., by withdrawal of the bending jaw 3 from its swivel axis S. To achieve this, the adjusting movement of the bending jaw 3 in the direction of the arrows A has to be supplemented by a further adjustment which is indicated by the arrows B in FIG. 1. This second adjustment is carried out in a direction which always extends essentially perpendicular to that plane which is respectively defined by the first direction of adjustment A and the swivel axis S and is indicated by the arrows B. During the adjustment of the bending jaw 3 in the direction of the arrows B, the bending jaw moves towards the planes defined by the directions of adjustment A and the swivel axis S.

This allows perfect rolling movement of the bending jaw 3 on the underside of the metal sheet 4 in such a way that the slide path between bending jaw 3 and metal sheet 4 is practically reduced to zero.

FIG. 2 shows schematically in a front view the right side of a swivel bending machine 10 with a machine frame 11 and the right end faces of the upper jaw 2 and the bending jaw 3 (the lower jaw 1 is hidden by the bending jaw 3). The left end face of the swivel bending machine, not illustrated in FIG. 2, is of corresponding, mirror-inverted design.

A hydraulic cylinder 12 serves to vertically displace the upper jaw 2 during clamping and releasing of the metal sheet 4, cf. arrows G. The bending jaw 3 can be swivelled about the swivel axis S with the aid of a motor 13, cf. arrows H.

Firstly, a first swing arm 14 mounted for rotation on the machine frame 11 can be swivelled by the motor 13 about the swivel axis S. Mounted for rotation on this first swing arm 14 is a second swing arm 16 which can be swivelled about an axis 15. As illustrated, the axis of rotation 15 of the second swing arm 16 lies below the swivel axis S of the first swing arm 14.

A piston-cylinder-unit 18 is provided between the protruding foot 17 of the second swing arm 16 and the bending jaw 3, its cylinder housing 19 being fixedly connected to the bending jaw 3 and its piston rod 21 to the foot 17. In this way, the piston-cylinder-unit 18 imparts longitudinal guidance to the bending jaw 3 on the second swing arm 16 so that when the unit 18 is actuated in the direction of arrows I, which correspond to arrows $A_1$ to $A_4$ in FIG. 1, the bending jaw 3 is adjustable perpendicularly to the swivel axis S.

With the aid of a drive motor 22 merely indicated in FIG. 2, the swing arm 16 is rotatable about the axis 15 relative to the first swing arm 14. This rotation provides the adjusting movement in the direction of arrows $B_1$ to $B_4$, explained hereinabove in conjunction with FIG. 1, which takes place perpendicular to the plane containing the arrows I and the swivel axis S (this plane is the drawing plane in FIG. 2).

The longitudinal guidance of the bending jaw 3 along the arrows A can, of course, also be designed in a different way than that shown in FIG. 2 and, in particular, another drive motor can also be used. The same applies to the adjustment of the second swing arm 16 relative to the first swing arm 14 which, for example, could likewise be carried out with the aid of a straight-line guide means extending perpendicular to the drawing plane of FIG. 2. In particular, the cylinder housing 19 could also be guided in a longitudinal guide means on the second swing arm 16 for sliding displacement in the direction of arrows I.

In any case, the bending jaw 3 is adjustable in the direction of arrows A and B during the bending operation and so the advantages mentioned hereinabove are achieved. The drive motors required for the adjustment, for example, the piston-cylinder-unit 18 and the motor 22, are preferably controlled by a given program in accordance with the desired bending contour. In the case of simple swivel bending machines, manual control is also possible.

If only adjusting movement of the bending jaw 3 in the direction of arrows $A_1$ to $A_4$ and I, respectively, is desired, i.e., without adjustability of the bending jaw 3 in the direction of arrows $B_1$ to $B_4$, the straight-line guide means in the form of the piston-cylinder-unit 18 can also be provided directly between the first swing arm 14 and the bending jaw 3. The second swing arm 16 is then eliminated.

I claim:

1. A device for bending a section of a metal sheet through a predetermined swivel angle including upper and lower jaws for clamping said sheet therebetween with said section protruding beyond said upper and lower jaws, a bending jaw having a bending surface for engaging said sheet metal section, means for swiveling said bending jaw about a stationary swivel axis in the course of bending said sheet section, means for adjusting said bending jaw during said swivel movement in a first direction of adjustment perpendicular to said swivel axis, the construction and operation of said bending jaw being such that its spacing from said swivel axis increases during the bending operation and that it is steerable along a predetermined bending contour, wherein the improvement comprises (a) means for additionally imparting to the first direction of adjustment a direction perpendicular to the bending surface of the bending jaw;

(b) a first swing arm for supporting said bending jaw and for swiveling said bending jaw about said stationary swivel axis and a first drive motor means for imparting longitudinal guidance to the bending jaw relative to the first swing arm in said first direction of adjustment so as to increase the spacing of the bending jaw from the stationary swivel axis, and (c) means to control said drive motor means by a given program in accordance with said predetermined bending contour.

2. A device as in claim 1 wherein said improvement comprises a second drive motor for also adjusting said bending jaw during its swivel movement in a second direction of adjustment which is essentially perpendicular to the plane containing said first direction of adjustment and said swivel axis.

3. A device as in claim 1 wherein said improvement comprises a second swing arm mounted for rotary movement on said first swing arm, means mounting said first drive motor means on said second swing arm, and a second drive motor means for rotating said second swing arm relative to the first swing arm in a second direction of adjustment which extends substantially perpendicular to the plane containing said first direction of adjustment and said swivel axis.

* * * * *